US005129252A

United States Patent [19]

Hahn et al.

[11] Patent Number: 5,129,252

[45] Date of Patent: Jul. 14, 1992

[54] CAN BODY MAKER WITH MAGNETIC RAM BEARING AND REDRAW ACTUATOR

[75] Inventors: Roger A. Hahn, Arvada; Phillip W. Gold, Lakewood; Harold Cook, Jr., Evergreen, all of Colo.

[73] Assignee: Coors Brewing Company, Golden, Colo.

[21] Appl. No.: 725,630

[22] Filed: Jul. 2, 1991

Related U.S. Application Data

[63] Continuation-in-part of Ser. No. 578,938, Sep. 7, 1990.

[51] Int. Cl.[5] ..... B21D 22/28

[52] U.S. Cl. ..... 72/349; 72/467

[58] Field of Search ..... 72/285, 347, 349, 465, 72/467

[56] References Cited

U.S. PATENT DOCUMENTS

| | | | |
|---|---|---|---|
| 3,696,657 | 10/1972 | Maytag . | |
| 3,735,629 | 5/1973 | Paramonoff . | |
| 3,779,063 | 12/1973 | Gannon | 72/467 |
| 3,877,761 | 4/1975 | Boden et al. . | |
| 3,955,394 | 5/1976 | Kaufman et al. . | |
| 4,141,604 | 2/1979 | Habermann et al. . | |
| 4,173,138 | 11/1979 | Main et al. . | |
| 4,180,296 | 12/1979 | Habermann . | |
| 4,353,602 | 10/1982 | Habermann . | |
| 4,473,259 | 9/1984 | Goldowsky . | |
| 4,504,098 | 3/1985 | Battarel et al. . | |
| 4,578,981 | 4/1986 | Nishikawa et al. . | |
| 4,583,794 | 4/1986 | Takahara et al. . | |
| 4,597,613 | 7/1986 | Sudo . | |
| 4,614,104 | 9/1986 | Straw . | |
| 4,642,500 | 2/1987 | Higuchi et al. . | |
| 4,795,927 | 1/1989 | Morii et al. . | |
| 4,807,459 | 2/1989 | Grims et al. . | |
| 4,827,169 | 5/1989 | Habermann . | |
| 4,841,212 | 6/1989 | Matsushita et al. . | |
| 4,892,328 | 1/1990 | Kurtzman et al. . | |
| 4,912,343 | 3/1990 | Stuart . | |
| 4,934,167 | 6/1990 | Grims et al. . | |

FOREIGN PATENT DOCUMENTS

| | | |
|---|---|---|
| 24842 | 10/1922 | France . |
| 453220 | 12/1974 | U.S.S.R. . |

OTHER PUBLICATIONS

Pamphlet entitled "Linear Induction Motors" of Northern Magnetics, Inc., Van Nuys, Calif., pp. 1-6.

Pamphlet by Northern Magnetics, Inc., Van Nuys, Calif., pp. 11-13 and 15-17.

Design Bulletin No. 4 of Northern Magnetics, Inc., Van Nuys, Calif. (1-78), pp. 1-13 and Tables.

Technical bulletin #769-3 of Northern Magnetics, Inc., Van Nuys, Calif.

Article entitled "Linear Induction: A New Way to Go," *Mechanix Illustrated* (Dec. 1975), pp. 38-40.

*Primary Examiner*—Lowell A. Larson

*Attorney, Agent, or Firm*—Klaas, Law, O'Meara & Malkin

[57] ABSTRACT

A can body maker apparatus of the type having an axially reciprocal ram member and an axially reciprocal redraw carriage comprising a ram position sensing assembly for sensing the position of the ram member and for generating a ram position signal in response thereto; an electromagnetic bearing assembly for frictionlessly radially supporting and aligning one end of the ram member with a predetermined ram displacement path; an electromagnetic redraw carriage actuator for applying magnetic force to the redraw carriage for reciprocating the redraw carriage; and a control assembly for selectively energizing and deenergizing electromagnets in the electromagnetic bearing assembly and the electromagnetic redraw assembly in response to the ram position signal.

19 Claims, 10 Drawing Sheets

CAN BODY MAKER WITH MAGNETIC RAM BEARING AND REDRAW ACTUATOR

This application is a continuation-in-part of copending U.S. patent application Ser. No. 578,938 filed Sept. 7, 1990, which is hereby incorporated by reference for all that it discloses.

FIELD OF THE INVENTION

This invention relates generally to a can body making apparatus and more particularly to a ram assembly and a redraw assembly thereof.

BACKGROUND OF THE INVENTION

A can body making apparatus is described in U.S. Pat. No. 3,696,657 issued to J. H. Maytag, which is hereby incorporated herein by reference for all that it discloses. The ram carriage and redraw carriage are each mounted on rollers which move over carriage way strips. Each pair of upper and lower rollers are urged toward each other so as to be in firm contact with the carriage way strip located therebetween. Both the ram and redraw carriages are reciprocated at rates sufficient to form about two hundred cans a minute. The constant reciprocal movement of the ram and redraw carriages and the tight engagement of the rollers on the carriage way strips result in wear which causes misalignment of the ram or of the can blanks by the redraw sleeve. It is understood that this misalignment is small, between about 0.005 and 0.010 of an inch, but such misalignment can result in defective cans.

Grims et al. U.S. Pat. No. 4,934,167, which is hereby incorporated by reference for all that it discloses, describes a can body making apparatus having an elongated ram which is connected to apparatus for producing straight line reciprocating motion and which is supported solely by a liquid bearing during the reciprocation thereof.

The Grims et al. patent also discloses a redraw apparatus for a can body making apparatus wherein the redraw carriage is slidably mounted on a pair of spaced apart support posts for reciprocal movement thereover. The support posts are fixedly mounted on a housing holding can forming and ironing dies.

Other U.S. patents which also describe body maker apparatus, which are all hereby specifically incorporated by reference for all that they disclose, are as follows: 4,614,104 of Straw; 4,578,981 of Nishikawa et al.; 4,173,138 of Main et al.; 3,955,394 of Kaufman et al.; and 3,735,629 of Paramonoff.

In certain fields of technology outside the present field of invention it is known to use magnet assemblies to support a moveable shaft. Magnet assemblies for supporting a moveable shaft are described in the following U.S. Patents which are hereby specifically incorporated by reference for all that is disclosed therein: 4,912,343 of Stuart; 4,892,328 of Kurtzman et al.; 4,831,212 of Matsushita et al.; 4,827,169 of Habermann; 4,795,927 of Morii et al.; 4,642,500 of Higuchi et al.; 4,597,613 of Sudo; 4,583,794 of Takahara et al.; 4,504,098 of Battarel et al.; 4,473,259 of Goldowsky; 4,353,602 of Habermann; 4,180,296 of Habermann; 4,141,604 of Habermann et al.; and 3,877,761 of Boden et al.

SUMMARY OF THE INVENTION

The present invention is directed to a can body maker which employs electromagnets in both a ram supporting bearing assembly and in a redraw carriage actuator. The electromagnets are energized and deenergized based upon ram position so as to maintain the ram at a radially centered position in a predetermined reciprocation path and so as to actuate the redraw carriage at appropriate times during a ram stoke.

Thus, the invention may comprise a method of maintaining a reciprocating ram of a can body maker apparatus in alignment with a predetermined linear reciprocation axis comprising the steps of: mounting a plurality of separately energizable electromagnets in an annular arrangement about a first predetermined axial portion of said linear reciprocation axis; selectively energizing said electromagnets so as to urge a portion of said ram which is circumscribed by said plurality of electromagnets into coaxial relationship with said reciprocation axis.

The invention may also comprise a method of actuating a redraw carriage which is reciprocally mounted on a can body maker comprising the steps of: mounting a first electromagnet assembly relatively forward of the redraw carriage; mounting a second electromagnet assembly relatively rearward of the redraw carriage; energizing the first electromagnet assembly so as to initiate a forward displacement of the redraw carriage; energizing the second electromagnet assembly so as to initiate a rearward displacement of the redraw carriage.

The invention may also comprise can body making apparatus for forming can blanks into elongated can bodies comprising: a stationary support frame; a housing having forming and ironing dies located therein mounted on said support frame; an elongated ram having a first end portion and a second end portion, said first end portion having a generally cylindrical outer surface for movement into said redraw assembly to contact a can blank in said redraw assembly and to move said can blank out of said redraw assembly and through said forming and ironing dies to form an elongated can body, said first end portion being constructed at least partially from magnetic material; reciprocating drive means for providing reciprocating axial displacement for said elongated ram; connecting means on said ram second end portion for connecting said elongated ram to said reciprocating drive means; and magnetic bearing means mounted on said support frame for radially centering and frictionlessly supporting said ram first end portion during reciprocating axial displacement of said ram.

The invention may also comprise can body making apparatus for forming can blanks into elongated can bodies comprising: a stationary support frame; a housing having forming and ironing dies located therein mounted on said support frame; an elongated ram having a first end portion and a second end portion, said first end portion having a generally cylindrical outer surface for movement into said redraw assembly to contact a can blank in said redraw assembly and to move said can blank out of said redraw assembly and through said forming and ironing dies to form an elongated can body, said first end portion being constructed at least partially from magnetic material-reciprocating drive means for providing reciprocating axial displacement for said elongated ram; connecting means on said ram second end portion for connecting said elongated ram to said reciprocating drive means; and a redraw assembly located adjacent to said housing, wherein said redraw assembly comprises: a redraw sleeve for supporting a can body preform thereon; redraw carriage means for supporting and axially displacing said redraw sleeve relative said elongated ram; first redraw electromagnet means fixedly positioned relative said stationary support frame at a location forward of said redraw carriage means for urging said redraw carriage means forwardly during an energized state thereof; second redraw electromagnet means fixedly positioned relative said stationary support frame at a location rearward of said redraw carriage means for urging said redraw carriage means rearwardly during an energized state thereof.

The invention may also comprise a can body maker apparatus of the type having an axially reciprocal ram member and an axially reciprocal redraw carriage comprising: ram position sensing means for sensing the position of said ram member and for generating a ram position signal in response thereto; electromagnetic bearing means for frictionlessly radially supporting and aligning one end of said ram member with a predetermined ram displacement path; electromagnetic redraw carriage actuator means for applying magnetic force to said redraw carriage means for reciprocating said redraw carriage means; control means for selectively energizing and deenergizing electromagnets in said electromagnetic bearing means and said electromagnetic redraw means in response to said ram position signal.

BRIEF DESCRIPTION OF THE DRAWING

Illustrative and presently preferred embodiments of the invention are shown in the accompanying drawings in which.

DETAILED DESCRIPTION OF THE INVENTION

In General

Figure 1:
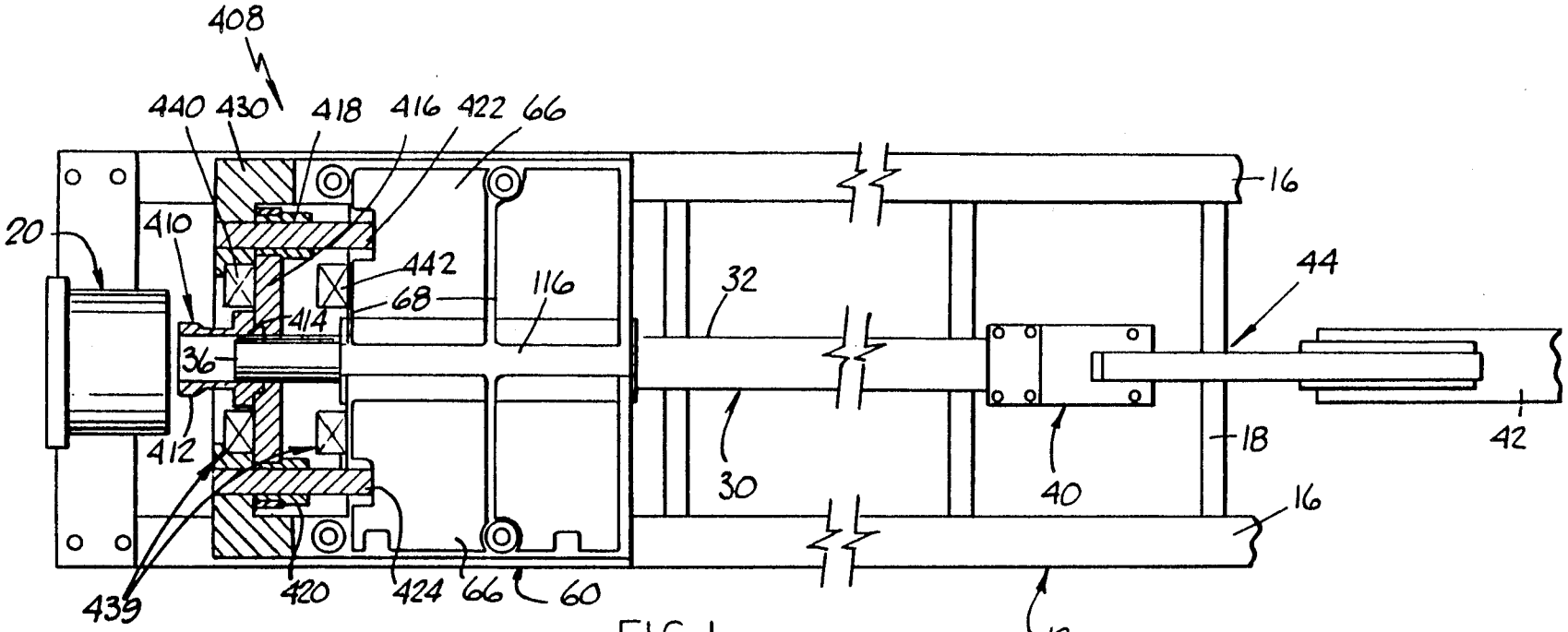
FIG. 1 is a partially cross sectional, top plan view of a can body maker apparatus.
Figure 2:
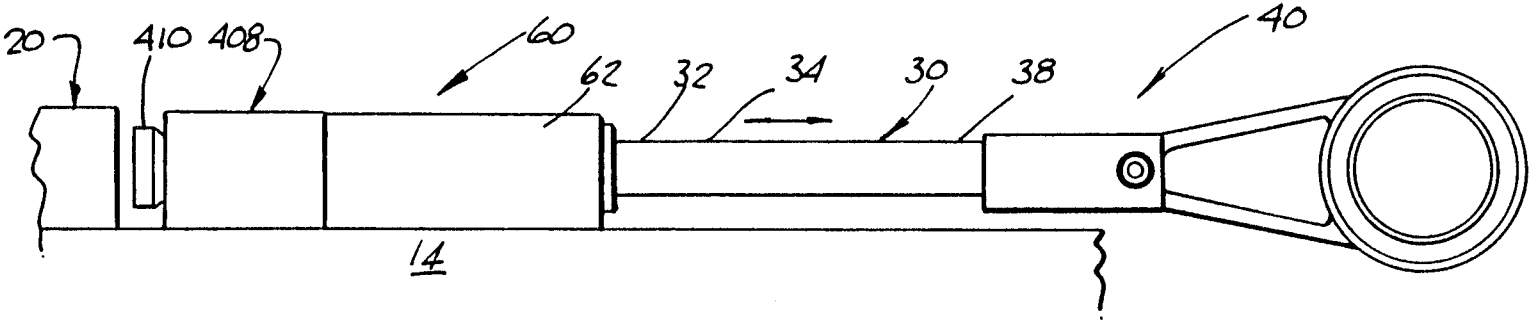
FIG. 2 is a side elevation view of the can body maker apparatus of FIG. 1.

FIG. 1 illustrates a can body maker apparatus 10 of the type having an axially reciprocal ram member 30 and a coaxially aligned redraw assembly 408 which is reciprocally displaceable independently of the ram member 30. A ram position sensing assembly 50, 148, 150, 248, 250, FIG. 4, senses the position of the ram member and generates a ram position signal in response thereto. An electromagnetic bearing assembly 60 frictionlessly radially supports and aligns the ram member with a predetermined ram displacement path RR. A redraw carriage actuator 439 applies magnetic force to a redraw carriage 416 which produces the reciprocal motion of the redraw assembly. A control unit 130 generates data signals for selectively energizing and deenergizing electromagnets in the electromagnetic bearing assembly 60 and the redraw carriage actuator 439 in response to the ram position signal.

Ram Assembly

As illustrated in FIG. 1, can body maker 10 comprises a support frame 12 comprising a pair of spaced apart linearly extending support beams 16 in parallel relationship and having support legs (not shown) fixedly mounted on a floating support base 12 as is conventional in the art. A plurality of cross-beam members 18 extend between and are connected to the support beams 16 to provide a rigid support structure. A housing 20 having conventional can forming and ironing dies located therein is fixedly mounted on the support beams 16 by suitable means such as nuts and bolts.

An elongated ram 30 is provided and has a main body portion 32 having a generally cylindrical outer peripheral surface 34 and which is constructed from a magnetic material such as steel. The elongated ram 32 has a first end portion 36 for movement into a redraw assembly to contact a can blank (not shown) located therein and to move the can blank through conventional can forming and ironing dies (not shown) in the housing 20 to form an elongated can body (not shown). The elongated ram 30 has a second end portion 38 which is securely mounted in a connecting device 40.

Apparatus 42 extends from machinery, such as the straight line motion assembly described in detail in the above referenced Maytag and Grims et al. patents, which provides the apparatus 42 with a reciprocating linear motion. A connecting arm 44 is connected to the apparatus 42 and the connecting device 40 to transmit the reciprocating linear motion to the connecting device 40 and the elongated ram 30. Apparatus 42 receives motive force from a crankshaft 46, FIG. 4, which is connected by conventional mechanical linkage to an electric drive motor 48. An electronic encoder unit 50 is mounted on the crankshaft 46 and generates a pulse signal which is representative of crankshaft angular position. In one preferred embodiment an encoder is selected which generates 10,000 pulses per crankshaft revolution. The encoder may be either an incremental, absolute, or linear position indicator type as are commercially available in the industry. The encoder pulse signal is provided to a data processing device having a pulse counter which resets at the beginning of each new crankshaft revolution. The ram performs one ram stroke per crankshaft revolution. The encoder pulse count is thus representative of ram axial position.

A magnetic bearing assembly 60 is mounted in a support structure 62 which is mounted on the support beams 16 so as to hold the magnetic bearing assembly 60 at a fixed location. The magnetic bearing assembly 60, described in more detail below, has a generally cylindrical inner surface 64, FIG. 3, having a diameter slightly greater than the diameter of the generally cylindrical outer surface 34 to provide for sliding movement of the ram main body portion 32 through the magnetic bearing assembly. The difference in diameters between the generally cylindrical outer surface 34 and the generally cylindrical inner surface 64 is between about 0.005 and 0.015 inches. The elongated ram 30 during the reciprocation thereof is frictionlessly supported solely by the magnetic force provided by the magnetic bearing assembly 60.

Figure 3:
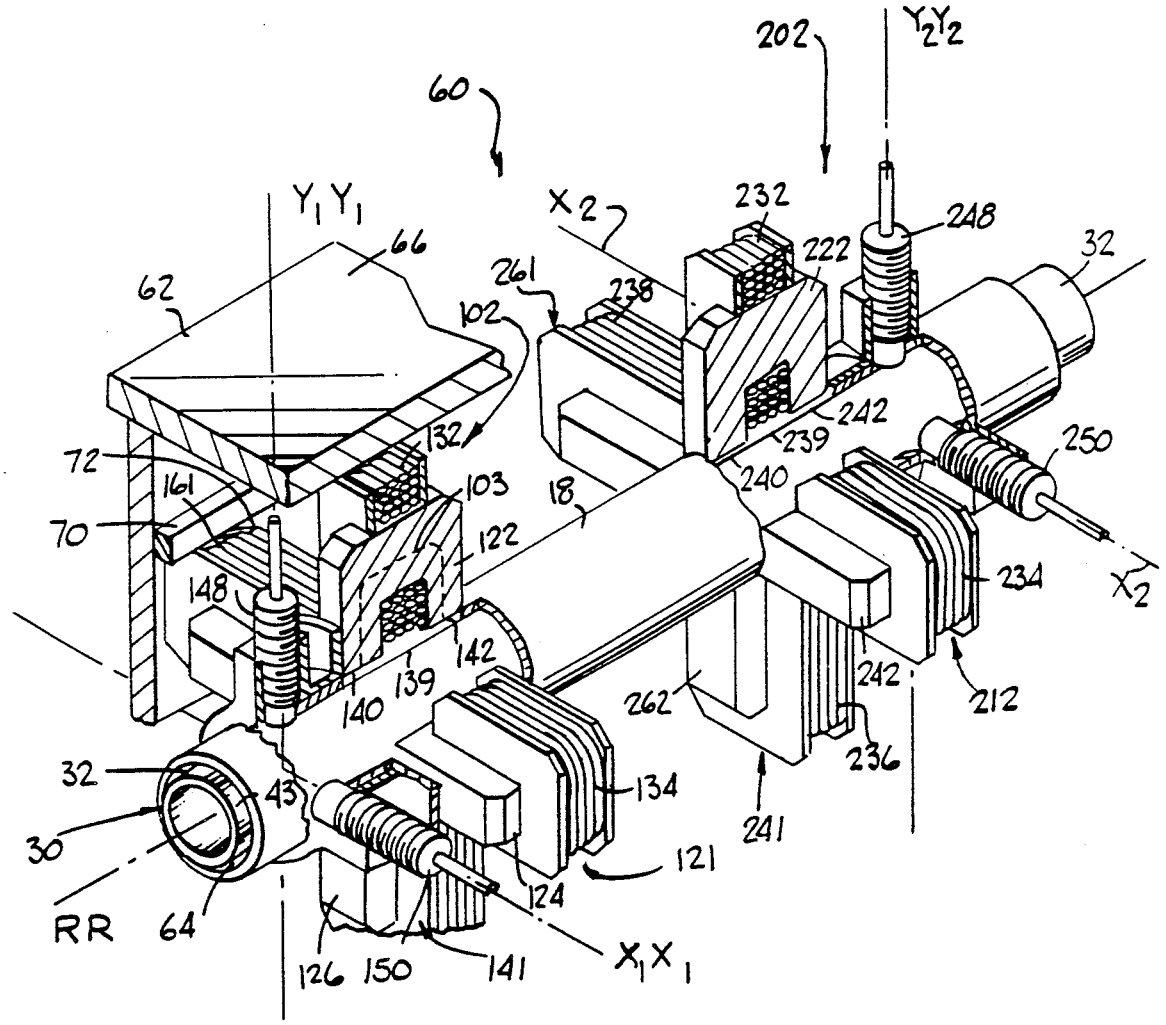
FIG. 3 is a perspective view of a ram magnetic bearing assembly.

The magnetic bearing support housing 62 is illustrated in FIGS. 1 and 3. The support housing 62 comprises an integral casting preferably formed from nonmagnetic material such as cast aluminum and has a pair of linearly extending beams 66 each having a generally planar bottom surface. Beams 66 abut and are attached to beams 16 of support frame 12. A plurality of reinforcing ribs 68 extend between and are integral with beams 66. An interior wall 70 of support housing 62 comprises a plurality of flange portions 72, etc., projecting therefrom which are adapted to be fixedly secured, as by attachment bolts, to various portions of the bearing assembly 60.

Magnetic bearing assembly 60 for frictionlessly supporting ram 30 main body portion 32 is illustrated in FIG. 3. The magnetic bearing assembly includes an elongated cylindrical sleeve 118 which comprises inner surface 64. A forward and a rear magnetic bearing, 102, 202 are provided by two sets of U-shaped stationary electromagnets 110, 112, 114, 116 and 210, 220, 224, 226 and position sensors 148, 150, and 248, 250 respectively are located at each end of sleeve 118 which may be 15 inches long.

Each set of electromagnets preferably consists of four electromagnets, e.g. 110, 112, 114, 116, located 90 degrees apart around the periphery of the sleeve 118 and are operable to generate four orthogonal magnetic fields 130 within the sleeve 118.

Each set of positions sensors, e.g. 148, 150, are aligned with associated electromagnets, e.g. 110, 112, to define two orthogonal horizontal $X_1X_1$, $X_2X_2$ and vertical $Y_1Y_1$, $Y_2Y_2$ axes from which signals proportional to orthogonal ram shaft displacement are provided. These signals are provided to a data processing unit 130, FIG. 4, which also receives the pulse signal from encoder 50.

Figure 4:
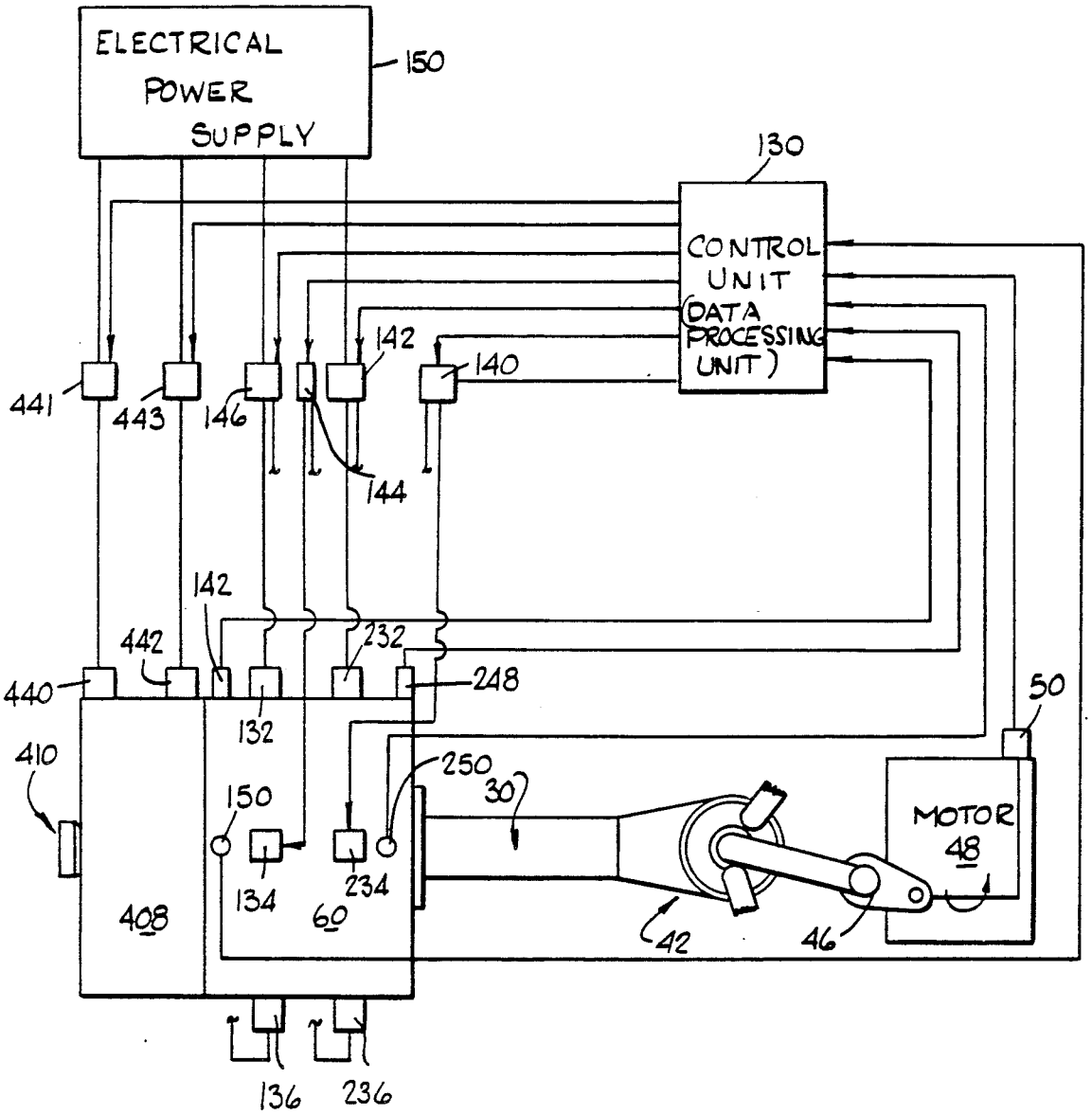
FIG. 4 is a schematic illustration of a control system for the ram and redraw assembly of the body maker apparatus of FIG. 1.

The data processing unit 130 issues control signals to control circuits 142, 144, 144, 146, FIG. 4, which controls the current flow from electric energy source 150 to each opposed set of electromagnets so as to energize the coil windings 132, 134, 136, 138 and 232, 234, 236, 238 for radially centering the elongated ram 30 within the sleeve 118. The electromagnets may be energized either in a linear fashion or in a pulsed manner as is well known in the art. In the preferred embodiment, pulsed energization is employed.

In one embodiment of the invention the data processing unit 130 generates control signals based solely on ram radial position as sensed by sensors 148, 150 248, 250. The data processing unit in this embodiment may comprise hard wired electronic components identical to those described in Goldowsky U.S. Pat. No. 4,473,259.

In a preferred embodiment of the invention which is presently the best mode contemplated, data processing unit 130 generates control signals based upon both ram radial position as sensed by sensors 148, 150 248, 250 and is also based upon ram axial position as indicated by encoder 50.

Figure 5:
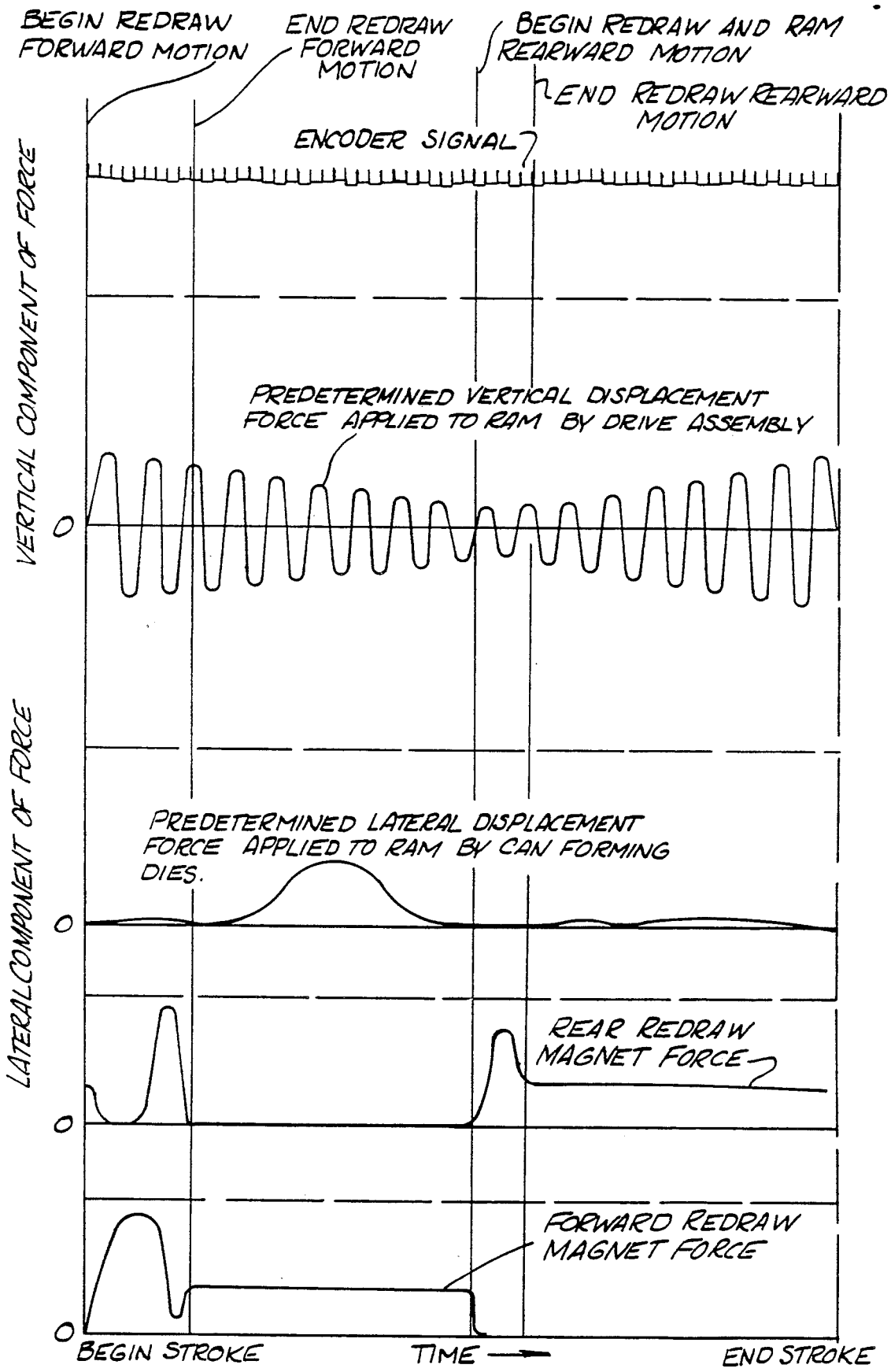
FIG. 5 is a graph illustrating typical vertical and lateral forces exerted on a bearing assembly by a ram.

As indicated in FIG. 5, encoder signal 300 comprises a set of signal pulses 302, 304, etc., which are indicative of the exact axial position of the ram 30 at any point in time. FIG. 5, also shows a force signal 310 which is typical of the total vertical force applied to a magnetic bearing e.g. 202 during a ram operating stroke. Forces which contribute to this total vertical force include a sinusoidal force applied by the ram drive apparatus 42 due to the fact that the linear motion assembly always has a small component of nonlinear force on apparatus 42. This force and also the force attributable to the weight of the ram 30 itself vary in magnitude during the ram stroke due to the changing length of the moment arm associated with each of these forces during a ram stroke. However, these components of the total vertical force exerted on the magnetic bearing are cyclical and under normal operating conditions represent substantially all of the vertical force which will be exerted on the magnetic bearing. This force may be empirically determined using conventional strain gages and/or other means and may be stored as a function of ram axial position in a conventional electronic storage medium such as the RAM of a conventional microcomputer which may comprise a portion of the data processing unit 50.

FIG. 5 further illustrates at 350 the total lateral side loading force which may typically be exerted on electromagnet bearing 202 by ram 30 The short interval large magnitude force indicated at 352 is primarily due to a side force experienced at the end of ram 30 as it moves through the can forming dies. This relatively large magnitude force is cyclical and, like the cyclical vertical force, may also be empirically determined and stored as a function of ram axial position.

There are various forms in which the data represented by curves 310 and 350 may be stored which enables the force value associated with a particular ram position to be readily determined, e.g. in computer look up table form or as a mathematical formula derived by conventional curve matching techniques. As used herein the process of obtaining a force value from this predetermined correlated and stored information representative of ram axial position and associated force will be referred to as "applying a predetermined algorithm" to the ram axial position value regardless of whether the data is stored as a mathematical equation, in a look up table or in any other readily retrievable form.

Since the solid lines 310, 350 represent the force applied to a magnetic bearing by the ram during a normal ram stroke it will of course be necessary for the bearing assembly to apply an identical amount of force to the ram 30 at the corresponding axial positions in order to maintain the ram in a centered position in the bearing. Accordingly in one preferred embodiment of the invention the data processing means, which may comprise a conventional microprocessor, at predetermined intervals, e.g. every 5 milliseconds, reads the encoder count and applies a predetermined algorithm thereto based upon the empirically determined force relationship e.g. 310 in order to determine the force to be applied and then provides a control signal to the control circuitry for the associated opposed pairs of magnets e.g. 232, 236, which causes the magnets to apply the determined force to the ram. It will of course be appreciated that in implementing this method of control a separate force/axial position algorithm is determined and stored for use in association with each opposed pair of electromagnets.

In addition to determining a first (primary) force signal based for each opposed pair of electromagnets based upon a stored axial position/force algorithm as described above, the data processing unit 130 may also determine a second (secondary) force signal based upon the radial position of the portions of the ram 30 sensed by sensors 148, 150 and 248, 250. Thus in addition to the primary force signal provided for each opposed magnet pair a secondary signal is also generated for each magnet pair which is added to the primary signal to provide a resultant signal which is used to determine the force applied by the magnet pair. This secondary signal may be generated in a manner identical to that described in the Goldowsky patent. Alternatively, this secondary force signal may be generated through the use of a predetermined algorithm which is stored in computer software and which is applied to the raw sensor signal generated by an associated radial position sensor.

As a further means of control data representative of the each radial position sensor signal value as a function of ram axial position is accumulated and stored for at least one and preferably about 20 previous ram strokes. This stored data is then processed and used to adjust the predetermined algorithm, e.g. 310, which is used to determine the primary force signal which is applied by an opposed magnet pair to the ram 30. Using this further means of control the primary control algorithm may be periodically modified to account for changing conditions, such as heating and cooling of machine components, which may effect the force which must be exerted on the ram to maintain it in a centered position during all phases of the stroke. Using this further means of control it may be possible to determine the primary control algorithm e.g. 310 for each opposed set of electromagnets, e.g. 232, 236, by starting with a straight line primary algorithm and simply running the apparatus. During initial stages of operation most of the control would be provided by the secondary control signal. As the number of operating cycles progress the primary control algorithm, through periodic adjustment would become more and more representative of the actual total control force required and would thus require progressively less adjustment by the secondary control force signal.

Figure 6:
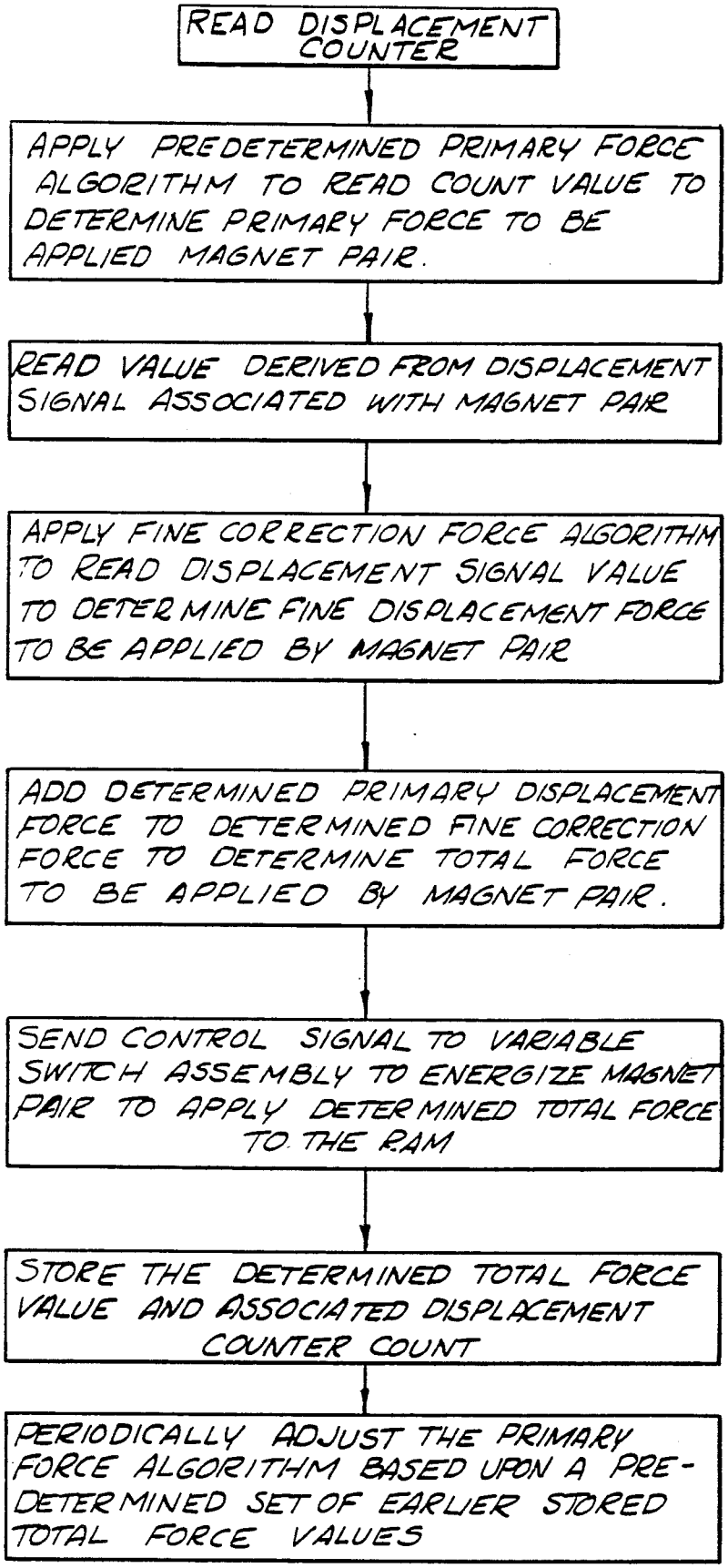
FIG. 6 is a block diagram illustrating the operation of a portion of the control system of FIG. 4.

The above described control method which provides a total control force signal based upon a primary force signal and a modifying secondary force signal and wherein an algorithm used to generate the primary force signal is periodically modified based upon a ram radial displacement signal is illustrated in block diagram form in FIG. 6. It will of course be understood that the method illustrated in FIG. 6 is described for a single pair of opposed electromagnets and that an identical process will be performed for each of the opposed pair of magnets at each sampling interval of the data processing means.

Redraw Assembly

As best illustrated in FIG. 1 redraw assembly 408 comprises a redraw sleeve 410 which is coaxial with ram displacement axis RR. Redraw sleeve 410 has a central cylindrical cavity extending therethrough which is adapted to slidingly receive ram member 30 therethrough. The general sequence of reciprocal motion of redraw sleeve with respect to the motion of ram 30 is as described in the above referenced Maytag patent.

The redraw sleeve 410 comprises a forward end 410 which is adapted to receive a can body preform known as a cup (not shown) thereon. The redraw sleeve comprises a rear end 414 which is fixedly secured to a redraw carriage 416.

The redraw carriage has a first and second bushing 416, 418 mounted therein which are adapted to slide on post members 422, 424. The post members have rear end portions which are fixedly mounted on a forward portion of ram bearing housing 62 and which have forward end portions which are fixedly mounted on redraw support bracket 430 which is itself attached to the ram housing 62.

A redraw actuator assembly 439 is fixedly supported by the support bracket 430. The actuator assembly comprises a forward ring shaped electromagnet 440 positioned forwardly of the redraw carriage and defining the forwardmost travel position of the redraw carriage. The actuator assembly also comprises a rear ring shaped electromagnet 442 positioned rearwardly of the redraw carriage and defining the rearwardmost travel position of the redraw carriage.

Figure 7:
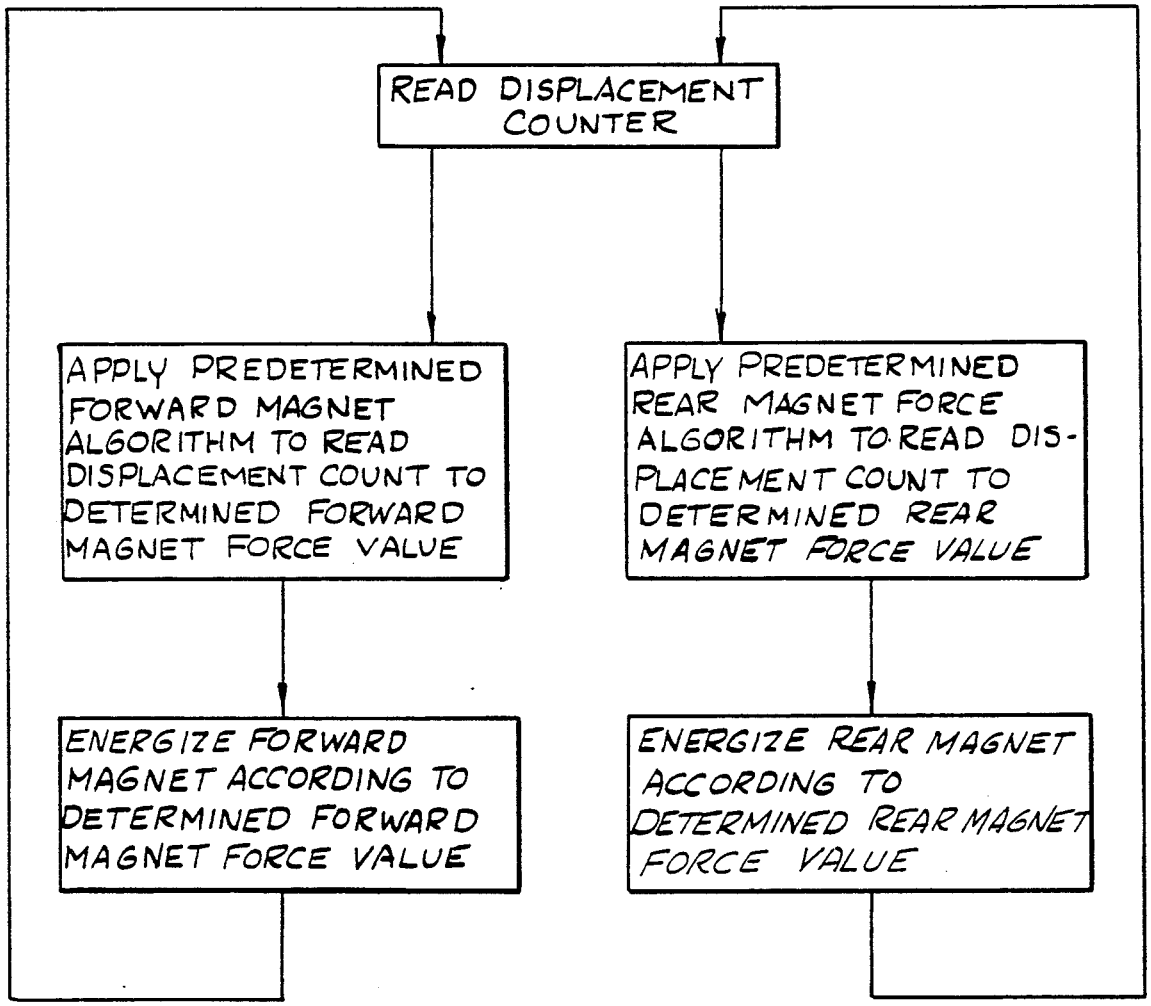
FIG. 7 is a block diagram illustrating the operation of another portion of the control system of FIG. 4.

As illustrated in FIG. 4, the forward and rear redraw magnets 440, 442 are energized and deenergized in response to control signals generated by data processing unit 130. As shown by FIG. 4 and the block diagram of FIG. 7, the data processing means generates control signals which are sent to control circuits 441, 443 to energize or deenergize electromagnets 440, 442. The control signals are generated in response to ram 30 position as determined by the pulse signal from encoder 50. The control signal for each electromagnet 440, 442 is generated by applying a predetermined algorithm to the ram position signal. The algorithm which is applied may be determined analytically or empirically. The resulting force applied by each of the electromagnets causes the redraw carriage to begin moving forwardly at the beginning of each ram stroke. The forward movement of the redraw carriage is sufficiently fast such that the cup carried by the redraw sleeve it moved into engaged position with the tool pack housing 20 prior to the arrival of the ram 30. However the redraw carriage must decelerate sufficiently prior to housing 20 engagement such that there is relatively little rebound at engagement. FIG. 5, illustrates a typical force profile for obtaining such a result. The electromagnets are energized and deenergized in a similar manner to return the redraw carriage to its rearmost position at approximately the same time that the ram 30 begins its rearward travel.

Die Assembly

A problem is encountered during the forming of cans when the central axis of the ram is not coaxially aligned with the central longitudinal axis of a forming die as the ram passes through the forming die. Such misalignment causes excessive die wear and also produces can bodies of uneven wall thickness. This problem has existed to a greater or lesser extent in nearly all can body maker assemblies regardless of the initial accuracy of alignment between ram and dies due to the fact that the axis of the ram tends to shift radially as the body maker temperature increases and the machine tolerances of various components charge. The ram unit may also shift radially during any stroke cycle such that the centerline of the ram is located at one radial position when a ram enters a die on during a forward portion of a ram stroke and is located at a slightly different radial position when the ram enters the die during the return portion of the stroke. A cam die assembly which corrects this problem is described below with reference to FIGS. 8–12.

Figure 8:
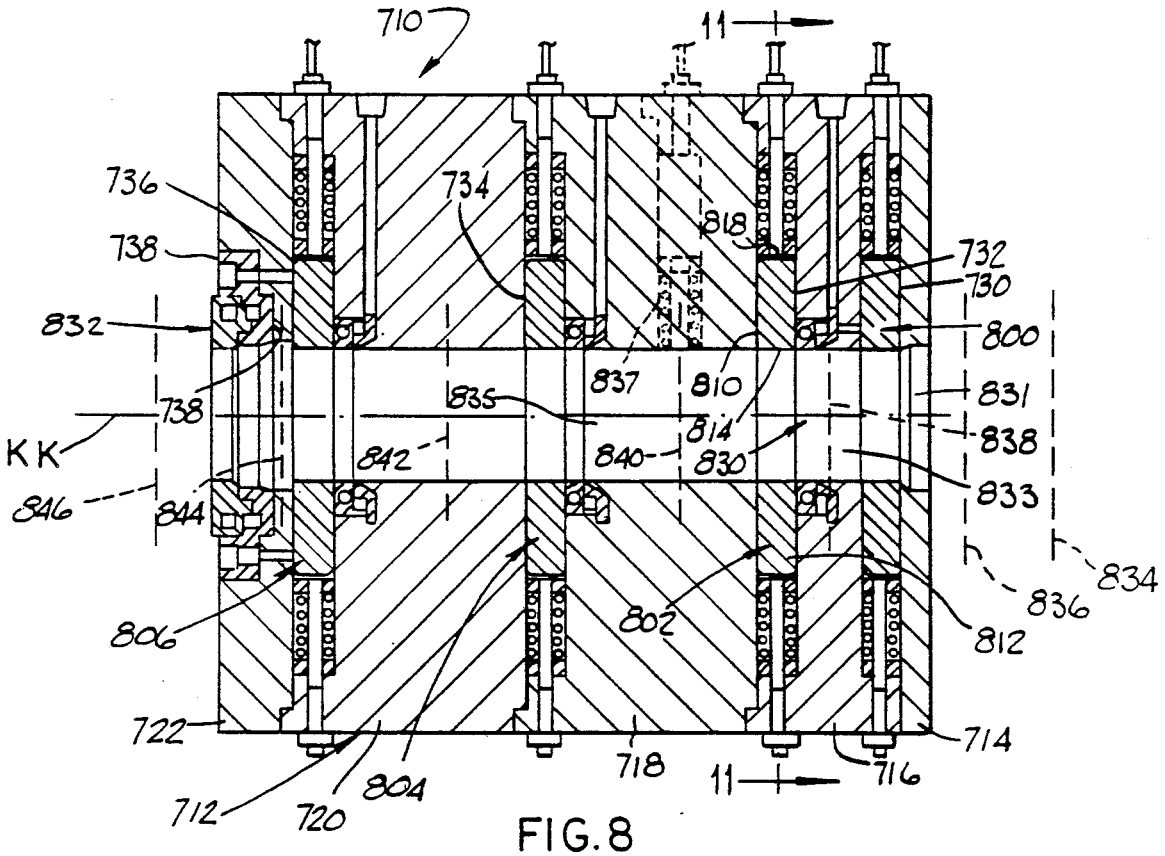
FIG. 8 is a cross-sectional side elevation view of a can forming and ironing die electromagnetically actuated can die assembly.
Figure 9:
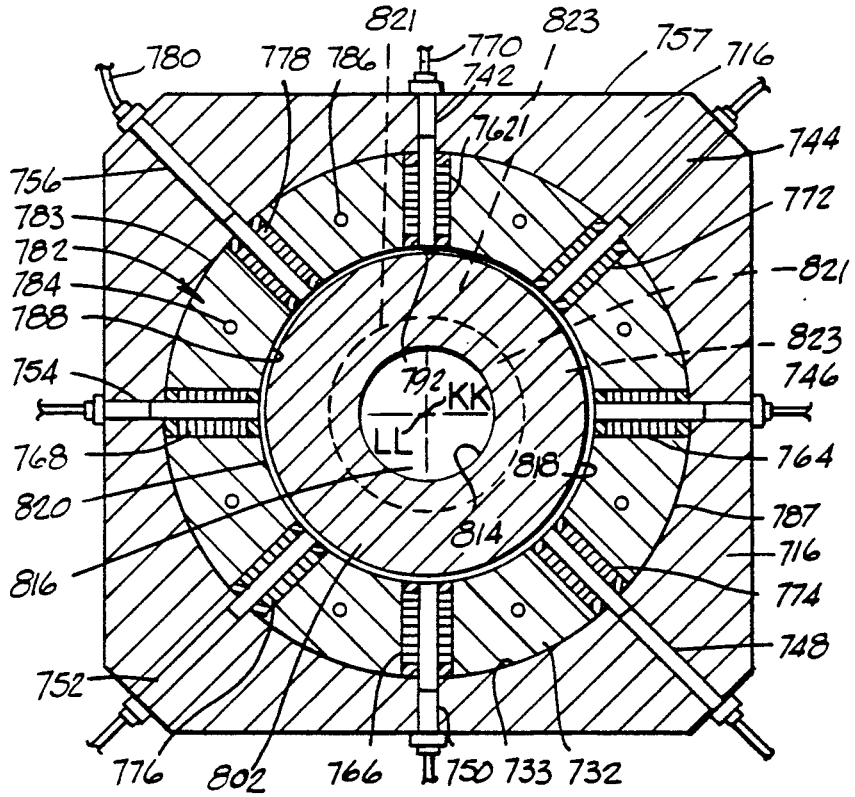
FIG. 9 is a rear cross-sectional elevation view of the electromagnetically actuated can die assembly of FIG. 10.

FIGS. 8 and 9 illustrate an electromagnetically actuated can die assembly 710 which may be used in the alternative to the conventional can forming and ironing die assembly within housing 20 illustrated in FIG. 1. Details of the construction of one prior art die assembly are disclosed in U.S. Pat. No. 4,843,863 for CONTAINER BODY MAKER DIE of Conrad M. Grims and Bruce A. Moen, which is hereby specifically incorporated by reference for all that is disclosed therein.

Electromagnetically actuated can die assembly 710 comprises a block member 712 having a central longitudinal axis KK which is nominally coaxial with the reciprocation axis RR of ram 30. The block member 712 comprises a plurality of interconnected block sections 714, 716, 718, 720, 722 which are conventionally fixedly attached to one another as by bolt assemblies (not shown) received within bores provided through the block sections (not shown) or other conventional attachment means. Each of the block sections comprises a relatively large cylindrical cavity 730, 732, 734, 736, 738 which is centered about block member longitudinal axis KK. Cavities 730, 732, 734, 736 are identical in size and are adapted to accept can forming die members 800, 802, 804, 806 as described in further detail below. Cavity 738 is adapted to receive stripper assembly 832.

As illustrated in FIG. 9, each of the cylindrical cavities 730, 732, 734, 736, of which cavity 732 is exemplary, communicates with a plurality of radially outwardly extending tapped bores 742, 744, 746, 748, 750, 752, 754, 756. The tapped bores terminate at their radially outer ends at the surface 757 of the associated block section, e.g. 716.

Electromagnet units 762, 764, 766, 768 are positioned in bores 742, 746, 750, 754, respectively. The central longitudinal axis of each electromagnetic unit is positioned in a common plane and intersects the central longitudinal axis KK of the block assembly at right angles therewith. As illustrated in FIG. 9, the electromagnetic units may be positioned with units 742 and 766 aligned with a vertical axis, and with units 764 and 768 aligned with a horizontal axis. The electromagnetic units may be of a conventional type such as those described above with reference to the ram bearing assembly. Each of the electromagnet units comprises leads 770 for connecting it to a controlled electrical power supply which may be identical to that described above with reference to FIG. 4.

Proximity sensors 772, 774, 776, 778 are provided in bores 744, 748, 752, 756 which have axes positioned in a common plane intersecting block central longitudinal axis LL at right angles thereto. Each of the proximity sensors may be positioned symmetrically between adjacent electromagnet units. Each of the proximity sensors has a lead 780 connecting it to a data processing unit 850 described in further detail below.

Each of the electromagnet units and proximity sensors comprises an outer end portion supported in an associated bore through block 716 and comprises an inner end portion which is supported against circumferential movement by a non-metallic support ring 782 having voids therein conforming to the shape of each of the proximity sensors and electromagnet units. The non-metallic support ring may be constructed of, e.g, phenolic material and is held in circumferentially stable position with respect to the associated block section 716 as by dowels received in dowel holes 784, 786, etc. and corresponding dowel holes in block 716. The support ring 782 has an outer cylindrical wall surface 787 which is equal in diameter and in axial dimension to the inner cylindrical wall surface 733 of the associated cylindrical cavity 732 of the block section. The support ring has an inner cylindrical surface 788 having an axial dimension approximately equal to that of cavity 733 and having a diameter slightly larger than the diameter of an associated die 802 as described in further detail below. The inner end 792 of each electromagnetic unit and the inner end 794 of each proximity sensor terminates at or slightly radially outwardly of surface 788.

As best illustrated in FIG. 8, can forming dies comprising a redraw die 800 and three ironing dies 802, 804, 806 are provided in associated cavities 730, 732, 734, 736 of the block assembly within an associated non-metallic support ring, e.g. 782. Each die comprises a forward planar surface 810, a rear planar surface 812, an inner cylindrical surface 814, and an outer cylindrical surface 818. The inner cylindrical surface defines a central cylindrical cavity 816 having a central longitudinal axis LL. Outer cylindrical surface 818 has a slightly smaller diameter than surface 788 of the support plate, e.g. 0.300 inches smaller, so as to provide a gap 820 of 0.150 inches between surface 818 and surface 788 when the die axis LL is coaxial with the block axis KK.

In one preferred embodiment, the die is constructed from magnetic material such as iron and is radially displaced through the attractive force which is controllably provided by the electromagnets 762, 764, 766, 768. In an alternative embodiment of the invention, the die 802 comprises a permanent ring magnet having one pole, e.g. the north pole, located at the radially inwardly positioned periphery 814 and the other pole, e.g. the south pole, positioned on the radially outwardly positioned periphery 818. Depending upon the type of permanently magnetized material which is used, it may be preferable to provide a die formed as a compound ring comprising an inner member 821, FIG. 9, which is not a permanent magnet which is press-fitted into an outer ring 823 which is a permanent ring magnet magnetized with one pole at its outer periphery and the other pole at its inner periphery. In either such embodiment, the poles of the electromagnets 762, etc. may be situated such that the pole of each electromagnet which is located adjacent the periphery of the die is of the same polarity as the outer periphery of the die. In other words, if outer die surface 818 is a north pole, then the radially inner end of each electromagnet 762, etc. is also a north pole. In such an arrangement, positioning of the die 802 is achieved through use of repulsion force provided by the electromagnets rather than attraction force as described in the previous example.

As illustrated in FIG. 8, conventional cooling rings 830 may be provided in associated cavities of each block section which interface with the rear surface 812 of each die to remove heat therefrom. Cooling rings are well-known in the art and will thus not be further described.

A stripper assembly 832 is provided at the end of the die to remove a can body from the ram after forming. The stripper assembly 832 may be a conventional stripper assembly or may comprise an electromagnetically actuated stripper assembly.

As further illustrated in FIG. 8, each block section, in addition to comprising a relatively large diameter cylindrical cavity, e.g. 810, for accepting an associated die 802 and support ring 782, comprises a smaller diameter cylindrical cavity, e.g. 831, 833, 835, etc. extending axially therethrough in axial alignment with the larger diameter cavities which enables passage of ram 30 therethrough. A plurality of ram proximity sensors (only one shown) 837 may be provided at a plurality of ram proximity sensor stations 834, 836, 838, 840, 842, 844, 846 along axis KK. In one preferred embodiment, there are four equally circumferentially spaced ram proximity sensors 837 located at each station at a position radially adjacent to cavities 834, 836, 838, 840, etc. The ram proximity sensors operate to sense the radial position of the ram in the same manner as the ram proximity sensors described above with reference to FIG. 3 which sense the position of the ram within a magnetic bearing.

Figure 10:
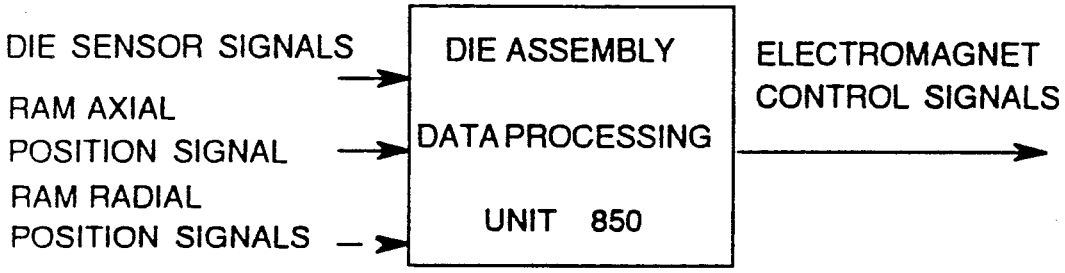
FIG. 10 is a block diagram illustrating inputs and outputs of a data processing unit used to control die position within an electromagnetically actuated can die assembly.
Figure 11:
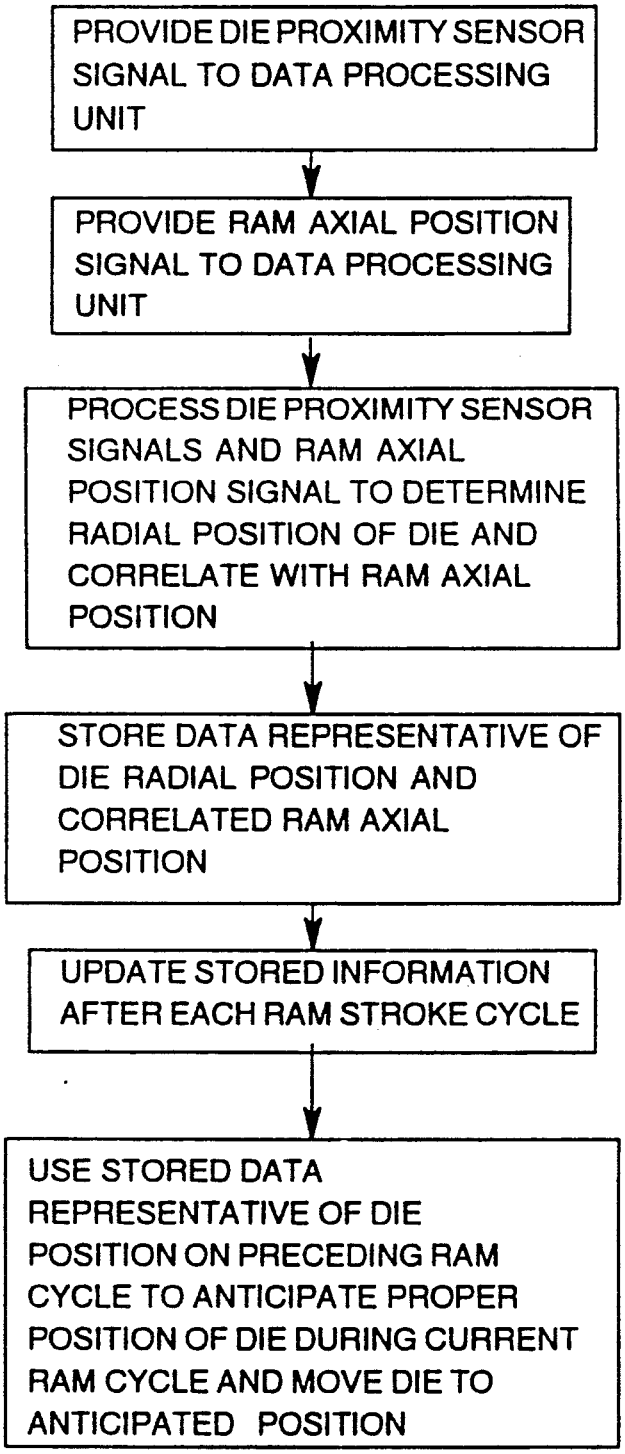
FIG. 11 is a flow chart illustrating operations performed by the data processing unit of FIG. 10 in one mode of operation.

As illustrated in FIG. 10, the electromagnet units which control the position of each die are controlled through control signals generated by a die assembly data processing unit 850 which, in one embodiment, receives and processes die proximity sensor signals and ram axial position sensor signals in order to generate the control signals. The data processing unit 850 may comprise a computer provided with appropriate software or may comprise a dedicated circuit, or a combination of both. The basic operation of the data processing unit 850 of this preferred embodiment is illustrated in FIG. 11. The flow chart illustrated in FIG. 11 is representative of the operations needed for controlling a single die. It will, of course, be appreciated that a single data processing unit provided with conventional multiplexing interface circuitry, etc. may be used to perform the same operation for each die station.

As indicated in FIG. 11, the proximity sensor signals from each of the die sensors is continuously provided to the data processing unit 850. A ram axial position signal is also continuously provided to the data processing unit. The data processing unit applies appropriate algorithms to the die proximity sensor signals to determine the radial position of the die, i.e. the position of axis LL with respect to axis KK, at each data processing unit sampling interval. The axial position of the ram at each sampling interval is also monitored and correlated with the determined die radial position.

Next, this correlated information for each sampling interval is stored in an appropriate data storage unit. In one preferred embodiment of the invention, the sampling interval may be every 1.0 millisecond, and data representative of ram travel through the entire die assembly and a short distance forward and rearward thereof, e.g. 2 inches forward and rearward thereof, is recorded for each ram cycle including the forward and rearward movement of the ram. This stored information is retained for the next succeeding ram stroke and then updated after completion of the next succeeding ram stroke.

The stored correlated data is then used by the data processing unit during the next ram stroke to anticipate and move the associated die to the same position which it occupied in the monitored ram stroke. In one preferred embodiment, this electromagnetically controlled positioning of a die is performed twice during each stroke cycle, first to move the die to the position which it occupied during ram entry on the previous forward stroke portion, and then again to move the die to the position which it occupied during ram entry on the previous rearward stroke portion. The controlled die movement is produced when the enlarged end portion of the ram is absent from the die.

The die radial proximity sensor signals may be used by the data processing unit to determine die position, velocity and acceleration at any sampling point in time, and this information may be further used by the data processing unit to generate control signals which apply appropriate force to the die to achieve a desired amount of displacement using conventional control algorithms.

Figure 12:
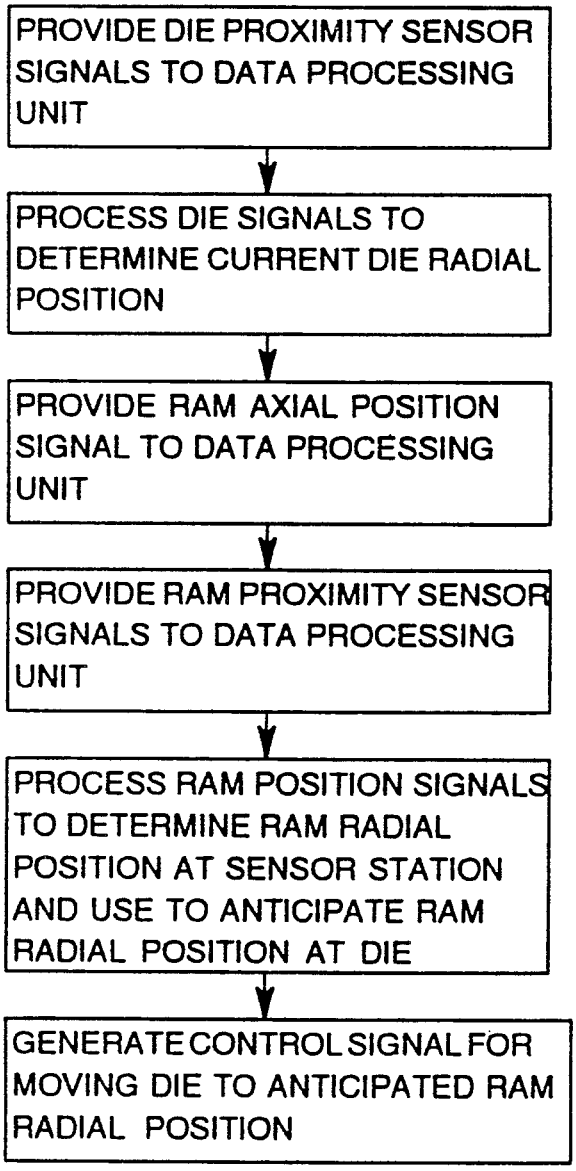
FIG. 12 is a flow chart illustrating operations performed by the data processing unit of FIG. 10 in an alternative mode of operation.

In another embodiment of the invention as illustrated in phantom lines in FIG. 10, an additional input is provided to the die assembly data processing unit 850. This additional input is the ram radial position signals which are provided by the ram proximity sensors 837 which are located at each of the die stations 834, 838, etc. The manner of control in this alternative embodiment is illustrated in FIG. 12. Die proximity sensor signals are provided to the data processing unit and are processed thereby to determine the die radial position. A ram axial position signal is provided to the data processing unit to indicate the instantaneous axial position of the ram. Ram radial position sensor signals are provided to the data processing unit as the ram passes through each ram sensor station, and these signals are processed by the data processing unit to determine the radial position of the ram at each sensor station. The determined ram radial position values are used in association with the ram axial position signal to anticipate the radial position which the ram will occupy when it reaches the next die station.

Next, the data processing unit, using the current die radial position and the anticipated ram radial position, generates a control signal to move the die to the anticipated ram radial position prior to the ram's arrival at that position such that the die is centered with respect to the ram when it arrives.

In yet another mode of operation, the control mode of FIG. 11 is used in association with the control mode of FIG. 12 to control the position of each of the can forming dies. In this method of operation, a control mode identical to that described with respect to FIG. 11 is used to position each of the dies at the beginning of a forward ram stroke and at the beginning of a rearward ram stroke in a coarse mode of operation. Then, in a fine mode of operation, the control process of FIG. 12 is implemented before the ram arrives at the die. The advantage of this coarse mode/fine mode operation is that a die is initially positioned at approximately the "correct" position as predicted by the previous ram stroke, and thus subsequent adjustments in the fine mode of operation will generally be smaller and thus will be capable of being implemented with greater speed than if the control system of FIG. 11 were used without such prior coarse mode correction.

While illustrative and presently preferred embodiments of the invention have been described in detail herein, it is to be understood that the inventive concepts may be otherwise variously embodied and employed and that the appended claims are intended to be construed to include such variations except insofar as limited by the prior art.

What is claimed is:

1. A method of maintaining an ironing die of a can body maker apparatus in alignment with a portion of a ram reciprocation axis which is circumscribed by said ironing die comprising the steps of:

mounting a plurality of separately energizable electromagnets in an annular arrangement about said ironing die;

selectively energizing said electromagnets so as to urge said ironing die into coaxial relationship with said circumscribed portion of said ram reciprocation axis.

2. The method of claim 1 comprising the further step of sensing the position of said ram and generating a ram position signal indicative thereof and wherein the step of selectively energizing said electromagnets comprises energizing said electromagnets responsive to said ram position signal.

3. The method of claim 2 wherein the step of sensing the position of said ram and generating a ram position signal indicative thereof comprises the step of sensing the radial position of said ram and generating a ram radial position signal indicative thereof.

4. The method of claim 3 comprising the further step of energizing said electromagnets as a function of said radial position signal.

5. The method of claim 2 wherein the step of sensing the position of said ram and generating a ram position signal indicative thereof comprises the step of sensing the axial position of said ram and generating a ram axial position signal indicative thereof.

6. The method of claim 5 wherein the step of energizing said electromagnets responsive to said position signal comprises energizing said electromagnets as a function of said ram axial position signal.

7. The method of claim 1 comprising the further step of sensing the radial position of said die and generating a die position signal indicative thereof and wherein the step of selectively energizing said electromagnets comprises energizing said electromagnets responsive to said die position signal.

8. The method of claim 1 comprising the steps of:

sensing the position of said ram and generating a ram position signal indicative thereof and wherein the step of selectively energizing said electromagnets comprises energizing said electromagnets responsive to said ram position signal; and sensing the radial position of said die and generating a die position signal indicative thereof and wherein the step of selectively energizing said electromagnets comprises energizing said electromagnets responsive to said die position signal.

9. The method of claim 8 wherein the step of sensing the position of said ram and generating a ram position signal indicative thereof comprises the step of sensing the axial position of said ram and generating a ram axial position signal indicative thereof.

10. The method of claim 8 wherein the step of sensing the position of said ram and generating a ram position signal indicative thereof comprises the step of sensing the radial position of said ram and generating a ram radial position signal indicative thereof.

11. The method of claim 9 wherein the step of sensing the position of said ram and generating a ram position signal indicative thereof comprises the step of sensing the radial position of said ram and generating a ram radial position signal indicative thereof.

12. In a can body maker apparatus, a method of controlling the radial position of a can ironing die which circumscribes a radially shifting reciprocation axis of a can body maker ram, comprising the steps of:

mounting a plurality of separately energizable electromagnets in an annular arrangement about said ironing die;

mounting a plurality of proximity detectors in an annular arrangement about said ironing die;

selectively energizing said electromagnets so as to frictionlessly suspend said ironing die;

during a first ram stoke engaging an inner circumferential portion of said die with a can blank mounted on said ram and radially urging said die into coaxial relationship with said ram axis during initial axial movement of said can blank through said die;

sensing the position of said die during said initial movement of said can blank therethrough; storing data representative of said sensed position;

prior to the engagement of said die with a can blank on the next ram stroke, selectively energizing said electromagnets as a funtion of said stored data.

13. The invention of claim 12 whereing the step of selectively energizing said electromagnets as a funtion of said stored data comprises positioning said die at said position which was sensed on the previous ram stoke.

14. In a can body maker apparatus, a method of controlling the radial position of a can ironing die which circumscribes a radially shifting reciprocation axis of a can body maker ram, comprising the steps of:

mounting a plurality of separately energizable electromagnets in an annular arrangement about said ironing die;

mounting a plurality of proximity detectors in an annular arrangement about said ironing die;

selectively energizing said electromagnets so as to frictionlessly suspend said ironing die;

sensing the position of said die during a first ram stroke;

storing data representative of said sensed position;

during a second ram stroke, selectively energizing said electromagnets as a funtion of said stored data.

15. Can body making apparatus for forming can blanks into elongated can bodies comprising:

a stationary support frame;

a housing having forming and ironing dies located therein mounted on said support frame;

an elongated ram having a first end portion and a second end portion, said first end portion having a generally cylindrical outer surface for movement into said redraw assembly to contact a can blank in said redraw assembly and to move said can blank out of said redraw assembly and through said forming and ironing dies to form an elongated can body;

reciprocating drive means for providing reciprocating axial displacement for said elongated ram;

said forming and ironing dies comprising at least one radially displaceable die member having an inner circumference adapted to engage a can blank and having an outer circumference;

a plurality of seperately energizable electomagnet means mounted in annular relationship about said outer circumference of said die member;

die position sensing means for sensing the radial position of said die member and for generating a die position signal indicative thereof;

data processing means for processing said die position signal and for generating a control signal dependent upon said die position signal for selectively energizing said electromagnet means for selectively controlling the position of said die member.

16. The invention of claim 15 further comprising:

ram position sensing means for sensing the position of said ram and generating a ram position signal indicative thereof;

said data processing means being adapted for receiving and processing said ram position sensing signal, said control signal being dependent upon said ram position signal.

17. The invention of claim 16 wherein said ram position sensing means comprises ram radial position sensing means.

18. The invention of claim 16 wherein said ram position sensing means comprises ram axial position sensing means.

19. The invention of claim 16 wherein said ram position sensing means comprises ram axial position sensing means and ram radial position sensing means.

* * * * *